US009145236B2

(12) United States Patent
Wyko et al.

(10) Patent No.: US 9,145,236 B2
(45) Date of Patent: Sep. 29, 2015

(54) ARTICLE WITH A LATCHING MECHANISM

(71) Applicant: HALLMARK CARDS, INCORPORATED, Kansas City, MO (US)

(72) Inventors: Rebecca Webb Wyko, Kansas City, MO (US); Orlanda Dominic Lacy, Kansas City, MO (US); Douglas Lee Krivanek, Lenexa, KS (US); John M. Decastro, Overland Park, KS (US)

(73) Assignee: HALLMARK CARDS, INCORPORATED, Kansas City, MO (US)

( * ) Notice: Subject to any disclaimer, the term of this patent is extended or adjusted under 35 U.S.C. 154(b) by 124 days.

(21) Appl. No.: 13/939,660

(22) Filed: Jul. 11, 2013

(65) Prior Publication Data

US 2015/0014401 A1 Jan. 15, 2015

(51) Int. Cl.
*B65D 27/20* (2006.01)

(52) U.S. Cl.
CPC ..... *B65D 27/20* (2013.01)

(58) Field of Classification Search
CPC ..... B42D 15/08; B65D 27/00; B65D 27/06; B65D 27/12; B65D 27/20; B65D 27/22; B65D 27/24; B65D 27/26; B65D 27/28
USPC ..... 229/68.1, 76, 77, 78.1, 78.2
See application file for complete search history.

(56) References Cited

U.S. PATENT DOCUMENTS

| | | | | | |
|---|---|---|---|---|---|
| 659,806 | A * | 10/1900 | Barnard | 229/78.2 |
| 1,179,718 | A * | 4/1916 | Hart | 229/77 |
| 1,272,428 | A * | 7/1918 | Hadley | 229/78.2 |
| 1,474,876 | A * | 11/1923 | Andrews | 229/78.2 |
| 1,484,177 | A | 2/1924 | Kellner | |
| 1,719,617 | A * | 7/1929 | Novick | 24/17 R |
| 1,953,852 | A * | 4/1934 | Gray | 229/78.2 |
| 2,281,296 | A * | 4/1942 | Rodiger | 229/77 |
| 2,373,380 | A * | 4/1945 | Cameron | 229/78.2 |
| 2,426,908 | A * | 9/1947 | Walsh | 229/77 |
| 2,594,050 | A * | 4/1952 | Matthiesen | 229/78.2 |
| 2,756,923 | A * | 7/1956 | Poppe | 229/77 |
| 2,925,951 | A * | 2/1960 | Davis | 229/77 |
| 3,750,938 | A * | 8/1973 | Wiseman | 229/77 |
| 3,788,539 | A * | 1/1974 | Vjecsner | 229/77 |
| 4,425,999 | A * | 1/1984 | MacDonald et al. | 206/308.3 |
| 7,383,947 | B2 * | 6/2008 | Naimo | 206/6.1 |
| 2005/0156019 | A1 * | 7/2005 | Collingham | 229/125.37 |

* cited by examiner

*Primary Examiner* — Jes F Pascua
*Assistant Examiner* — Peter Helvey
(74) *Attorney, Agent, or Firm* — Shook, Hardy & Bacon L.L.P.

(57) ABSTRACT

An envelope has a latching mechanism that is activated by a key to releasably secure a flap of the envelope in a closed position. The latching mechanism is located on the envelope's flap. The tip of the key fits into an aperture in the middle of the latching mechanism. Rotation of the key rotates ears on the back of the latching mechanism from a first position to a second position. In the first position, the ears align with a correspondingly-shaped opening in the front panel of the envelope, and the ears pass through the opening. Rotation to the second position rotates the ears behind the front panel such that the ears of the latching mechanism are now behind the front panel, thereby securing the opening of the envelope flap.

18 Claims, 5 Drawing Sheets

ARTICLE WITH A LATCHING MECHANISM

SUMMARY

This Summary is provided to introduce a selection of concepts in a simplified form that are further described below in the Detailed Description. This Summary is not intended to identify key features or essential features of the claimed subject matter, nor is it intended to be used in isolation as an aid in determining the scope of the claimed subject matter.

Embodiments of the present invention are directed towards an article, such as an envelope, that uses a latching mechanism activated by key or other similar objects to releasably secure a flap of the envelope in a closed position. By using the envelope as described, for example, a greeting card is presented in a unique way that prolongs the recipient's opening experience and heightens the enjoyment of the moment.

Accordingly, in one embodiment, the invention is directed towards an envelope having a latching mechanism. The envelope comprises a front panel having a receiving aperture, and a back panel connected with the front panel along a first common edge. The back panel is in parallel with the front panel when the envelope is in an as-constructed arrangement. Together, the back panel and the front panel define a receptacle for receiving an article. The envelope further comprises a closure flap connected with the back panel along a second common edge. A latching member is rotatably coupled to the closure flap and positioned on the closure flap to align with the receiving aperture when the envelope is in an as-constructed arrangement. The latching member in a first position aligns with the receiving aperture and can be inserted therein. In a second position, the latching member is rotated to maintain the latching member within the receiving aperture.

In a second embodiment, the invention is directed to an article having a latching mechanism. The article comprises a front panel having a receiving cutout, and a back panel connected with the front panel along a first common edge, where at least a portion of the back panel is in parallel with at least a portion of the front panel when the article is in an as-constructed arrangement, and where the back panel and the front panel define a receptacle for receiving an object. The article further comprises a closure flap connected with the back panel along a second common edge. A latching member is rotatably coupled to the closure flap and positioned on the closure flap to align with the receiving aperture when the article is in an as-constructed arrangement. The latching member in a first position aligns with the receiving aperture and can be inserted therein. In a second position, the latching member is rotated to maintain the latching member within the receiving aperture. The article also comprises a rotation restriction mechanism coupled to the closure flap and positioned on the closure flap to align with the latching member; the rotation restriction mechanism restricts rotation of the rotatable latching member to a predefined range of rotation.

In a third embodiment, the present invention is directed to an envelope having a latching mechanism. The envelope comprises a front panel having an interior face and an exterior face. The front panel comprises a receiving aperture having a shape, a spacer located on the interior face of the front panel and surrounding the receiving aperture, and a tab extending from the front panel and connected with the front panel along a first fold line, where the tab is pivotable with respect to the front panel along the first fold line, and where the tab overlies the spacer on the interior face of the front panel to create a cavity when the envelope is in an as-constructed arrangement.

The envelope further comprises a back panel connected with the front panel along a second fold line. The back panel is in parallel with the front panel when the envelope is in the as-constructed arrangement, and the back panel and the front panel define a receptacle for receiving a card when the envelope is in the as-constructed arrangement.

Continuing, the envelope also comprises a closure flap having an interior face and an exterior face. The closure flap comprises a distal panel and a proximal panel. The proximal panel is connected with the back panel along a third fold line, and the distal panel is connected with the proximal panel along a fourth fold line.

The distal panel comprises a latching member rotatably coupled to an exterior face of the distal panel and positioned on the distal panel to align with the receiving aperture when the envelope is in an as-constructed arrangement. The latching member comprises a central body and a pair of ears extending from the central body. The latching member has a shape corresponding to the shape of the receiving aperture of the front panel such that the latching member can be inserted into the receiving aperture to releasably secure the closure flap to the front panel of the envelope. The distal panel also comprises a rotatable portion of a rotation restriction mechanism positioned on an interior face of the distal panel. The rotatable portion of the rotation restriction mechanism comprises a body having a first centrally-situated aperture configured to receive an object and a finger integrally attached to and extending from the body. The rotatable portion of the rotation restriction mechanism is connected to the rotatable latching member via one or more attaching segments that extend through the distal panel of the closure flap.

The proximal panel of the closure flap comprises a non-rotatable portion of the rotation restriction mechanism positioned on an interior face of the proximal panel. The non-rotatable portion of the rotation restriction mechanism comprises: 1) a second centrally-situated aperture that aligns with the centrally-situated aperture of the rotatable portion of the rotation restriction mechanism when the envelope is in an as-constructed arrangement, and 2) a slot configured to receive the finger of the rotatable portion of the rotation restriction mechanism when the envelope is in the as-constructed arrangement. The slot has a length sufficient to restrict the rotation movement of the latching member through a 90 degree range.

BRIEF DESCRIPTION OF THE DRAWINGS

Embodiments of the invention are described in detail below with reference to the attached drawing figures, wherein.

DETAILED DESCRIPTION

The subject matter of embodiments of the invention disclosed herein is described with specificity to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies.

In general, the invention is directed towards an article having a latching mechanism that presents a gift item in a unique way that prolongs the recipient's opening experience and heightens the enjoyment of the moment. One exemplary embodiment includes a paper envelope that uses a paper latching mechanism activated by a plastic key to releasably secure a flap of the envelope in a closed position. The paper latching mechanism in the exemplary embodiment is constructed of card stock and is located on the envelope's flap. The paper latching mechanism is not meant to be burglar proof but, instead, is meant to provide a distinctive way to present a gift item such as a greeting card.

The tip of the plastic key, or other exemplary objects, fits into an aperture in the middle of the paper latching mechanism. Rotation of the key rotates ears on the back of the latching mechanism from a first position to a second position. In the first position, the ears align with a correspondingly-shaped opening in the front panel of the envelope, and the ears pass through the opening. Rotation to the second position rotates the ears behind the front panel such that the ears of the latching mechanism are now behind the front panel, thereby securing the opening of the envelope flap. Other exemplary embodiments of the present invention include gift boxes, gift bags and other three-dimensional articles with a latching mechanism.

Figure 1:
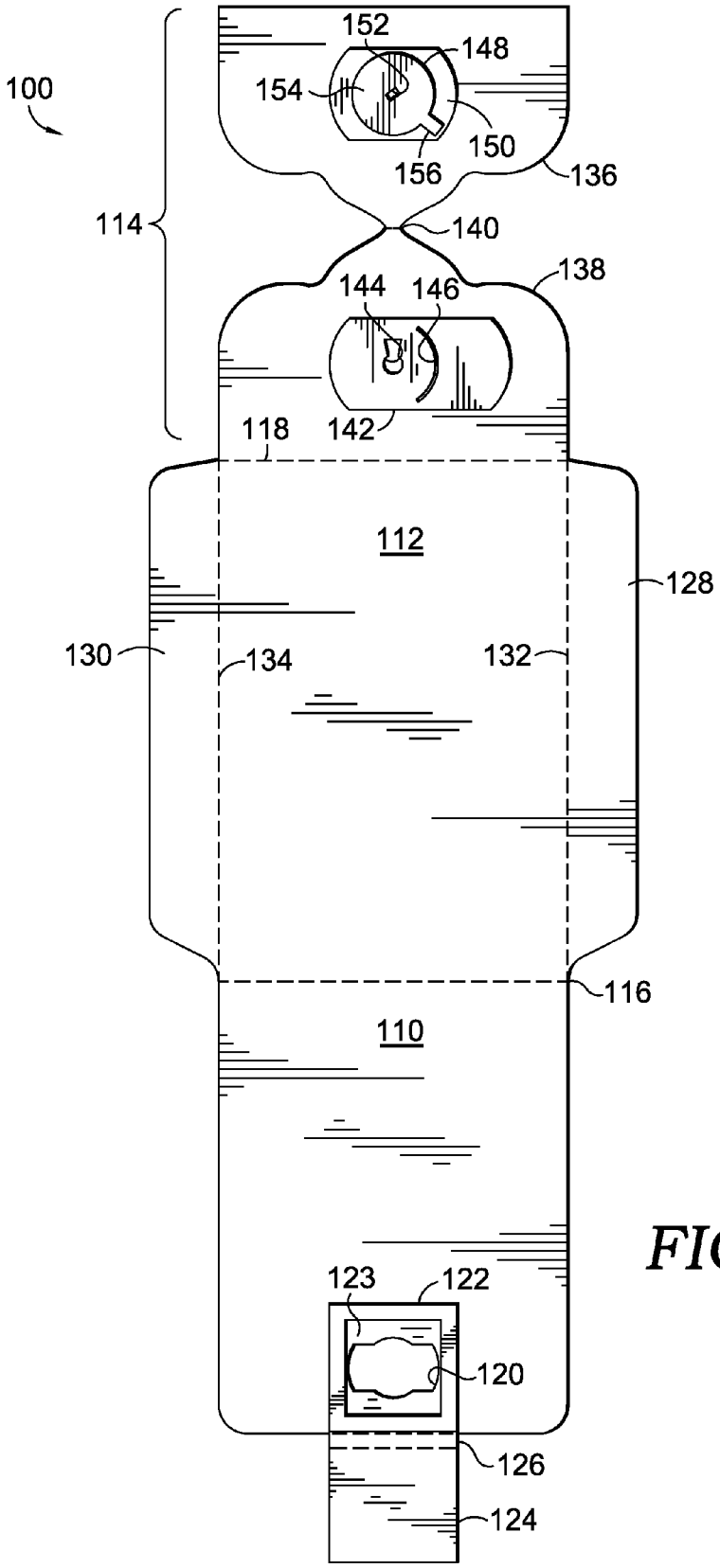
FIG. 1 is a top plan view of an interior face of an article with a latching mechanism in a deconstructed arrangement in accordance with embodiments of the present invention.

Turning now to FIG. 1, FIG. 1 depicts a top plan view of an interior face of an envelope 100 in a deconstructed arrangement. As used throughout this specification, the term "deconstructed arrangement" describes an article before construction into its final form or as-used form. In the case of the envelope 100, the term "deconstructed arrangement" describes the envelope 100 after it has been, for example, cut from paper or card stock and processed to a certain degree, but before it has been constructed into its final form. Likewise, the term "as-constructed arrangement" is used in the specification to describe the article in its final or as-used form.

In the illustrated embodiment, the envelope 100 includes a front panel 110, a back panel 112, and a closure flap 114. The front panel 110 is connected with the back panel 112 along a first common edge or first fold line 116, and the closure flap 114 is connected with the back panel 112 along a second common edge or second fold line 118. The front panel 110, the back panel 112, and the closure flap 114 may be constructed entirely of paper and/or card stock. In the illustrated embodiment, the paper comprises 150 grams per square meter (GSM) paper, although other weights are contemplated as being within the scope of the invention. In other exemplary embodiments, the envelope 100 may be constructed partially or entirely of other flexible materials such as fabric, plastic, metal, rubber, leather, and other similar materials. Any and all such aspects, and any combination thereof, are contemplated as being within the scope of the invention.

The front panel 110 includes a receiving aperture 120 that receives a latching member (not shown in FIG. 1) as will be more fully described below. The receiving aperture 120 may be in the form of a cutout that extends through the thickness of the front panel 110. In one aspect, the receiving aperture 120 may have a size and a shape sufficient to fully receive the latching member. In the illustrated embodiment 100, the size and the shape of the receiving aperture 120 has a one-to-one correspondence with the size and shape of the latching member.

The front panel 110 also includes a spacer 122. As shown, the spacer 122 surrounds the receiving aperture 120 and may be rectangular or square in shape although other shapes are contemplated (e.g., circle, oval, diamond, and the like). The spacer 122 rests upon a reinforcing layer 123 that has the same outside dimensions as the spacer 122. Further, the reinforcing layer 123 has a cutout that corresponds to the dimensions of the receiving aperture 120. The reinforcing layer 123 may be generated independently of the envelope 100 and attached to the envelope 100 using affixing technologies known in the art. In the illustrated embodiment, the reinforcing layer 123 is constructed of 20 pt. card stock. Other thicknesses are contemplated as being within the scope of the invention.

The dimensions of the spacer 122 are such that the area between the receiving aperture 120 and the spacer 122 is of a size sufficient to allow the latching member to rotate freely when the latching member is releasably secured to the front panel 110. The spacer 122 may be constructed or manufactured independently of the envelope 100 and attached to the reinforcing layer 123 of the front panel 110 of the envelope 100 using various affixing technologies known in the art (e.g., adhesives, spot welding, heat press, and the like). The spacer 122 may be constructed of card stock that has a thickness greater than the thickness of the front panel 110. The thickness of the spacer 122 may be between 0.2 and 0.5 mm, although other thicknesses are contemplated as being within the scope of the invention. The thickness of the spacer 122 is such that once the spacer 122 is attached to the front panel 110 and the envelope 100 is in the as-constructed arrangement, the spacer 122 helps to create sufficient space to allow for free rotation of the latching member once it is received by the receiving aperture 120.

The front panel 110 further includes a tab 124 that extends from the front panel 110 and is connected to the front panel 110 along a common edge or fold line 126. The tab 124 may be integrally connected to and extend from the front panel 110 in one aspect. In another aspect, the tab 124 may be constructed separately from the front panel 110 and attached to the front panel 110 along the common edge 126 using affixing technologies known in the art. The tab 124 is pivotable along the fold line 126, and when the envelope 100 is in the as-constructed arrangement, the tab 124 is pivoted inwardly towards the interior face of the front panel 110 and is attached to the spacer 122 using affixing technologies known in the art. The spacer 122 acts to create a space or cavity between the interior face of the front panel 110 and the tab 124. The latching member is received into this cavity and rotates freely within the cavity. Creation of a cavity using the tab 124 and the spacer 122 allows the latching member to rotate without inadvertently damaging the enclosed gift item.

The back panel 112 includes two side wings 128 and 130 that are connected to the back panel 112 along common edges or fold lines 132 and 134 respectively. The wings 128 and 130 may be integrally connected to and extend from the back panel 112 in one aspect. In another aspect, the wings 128 and 130 may be constructed separately from the back panel 112 and attached to the back panel 112 along the common edges 132 and 134 using affixing technologies known in the art. The wings 128 and 130 are used to attach the back panel 112 to the front panel 110 when the envelope 100 is in the as-constructed arrangement. In other exemplary embodiments, the wings 128 and 130 may have different dimensions than that shown in FIG. 1. For example, a gift box may have wings that extend further out from the back panel 112 as the wings would be used to potentially construct the sides of the gift box.

The closure flap 114 includes a distal panel 136 and a proximal panel 138. As shown in FIG. 1, the proximal panel 138 is connected with the back panel 112 along the second common edge 118. In one aspect, the proximal panel 138 is integrally connected to and extends from the back panel 112. In another aspect, the proximal panel 138 may be constructed separate from the back panel 112 and be connected to the back panel 112 along the second common edge 118 using affixing technologies known in the art. The proximal panel 138 is pivotable with respect to the back panel 112 along the second common edge 118. The distal panel 136 is connected to the proximal panel 138 along a fold line 140. The distal panel 136 may comprise an integral extension of the proximal panel 138 or may be constructed separately from the proximal panel 138 and attached to the proximal panel 138 along line 140 using affixing technologies known in the art. The distal panel 136 is pivotable along the fold line 140. In the as-constructed arrangement of the envelope 100, the distal panel 136 is pivoted inwardly towards the interior face of the envelope 100 along the fold line 140 and is attached to the proximal panel 138 using affixing technologies known in the art. In the illustrated embodiment, the distal panel 136 is a mirror-image of the proximal panel 138 although other configurations are contemplated.

The proximal panel 138 includes a non-rotatable portion 142 of a rotation restriction mechanism; the non-rotatable portion 142 is located generally in a central area of the proximal panel 138. The non-rotatable portion 142 may be constructed separately from the proximal panel 138 using card stock or other similar materials and attached to the interior face of the proximal panel 138 using affixing technologies known in the art. In the illustrated embodiment, the card stock may comprise 20 pt. card stock although other thicknesses are contemplated. The non-rotatable portion 142 includes a centrally-situated aperture or cutout 144 that extends through the non-rotatable portion 142. The centrally-situated aperture 144 may be in the shape of a keyhole to provide realism to the envelope 100. Other exemplary shapes are contemplated such as a square-shaped opening, a circle-shaped opening, and the like.

The non-rotatable portion 142 also includes an arc-shaped slot 146. The arc-shaped slot 146 comprises a slot or opening cut into the non-rotatable portion 142 (but not through the proximal panel 138) that receives a finger of a rotatable portion of the rotation restriction mechanism as explained below. The arc-shaped slot 146 has a length sufficient to restrict rotation of the latching member through an approximately 90 degree range.

The interior face of the distal panel 136 includes a rotatable portion 148 of the rotation restriction mechanism. The rotatable portion 148 partially or entirely lies on a reinforcing layer 150 that is separate from the distal panel 136 but is attached to the distal panel 136 using affixing technologies known in the art. The rotatable portion 148 is connected to the latching member (not shown) via one or more attaching segments (not shown) that are situated in cutouts in the reinforcing layer 150 and the distal panel 136. This aspect will be explained in greater depth below with respect to FIG. 5. The rotatable portion 148 and the reinforcing layer 150 may be constructed from card stock or other similar materials. In the illustrated embodiment, the reinforcing layer 150 is constructed of 20 pt. card stock, although other thicknesses are contemplated. The rotatable portion 148 may also be constructed of 20 pt. card stock. In one aspect, the rotatable portion 148 may comprise a two-ply arrangement to increase durability of the rotatable portion 148.

The rotatable portion 148 includes a rotatable body 154 having a finger 156 extending from and integrally connected to the body 154. The body 154 has a centrally-situated aperture 152 configured to receive an object such as a key. When the envelope 100 is in the as-constructed arrangement, the centrally-situated aperture 152 of the rotatable body 154 aligns with the centrally-situated aperture 144 of the non-rotatable portion 142 such that an object inserted in centrally-situated aperture 144 of the non-rotatable portion 142 is also inserted into the centrally-situated aperture 152 of the rotatable body 154. Rotation of the object therefore causes the rotatable body 154 to rotate. Further, when the envelope 100 is in the as-constructed arrangement, the finger 156 is received into the arc-shaped slot 146 of the non-rotatable portion 142.

Because the arc-shaped slot 146 is of a fixed length, rotation of the rotatable body 154 in one direction eventually causes the finger 156 to abut one end of the arc-shaped slot 146 thereby preventing rotation of the rotatable body 154 (and its attached latching member) beyond a certain point when the envelope 100 is in the as-constructed arrangement. Likewise, rotation of the rotatable body 154 in the opposite direction will cause the finger 156 to eventually abut the other end of the arc-shaped slot 146 thereby preventing rotation of the rotatable body 154 beyond a second point when the envelope 100 is in the as-constructed arrangement. The end result is that the finger 156 in combination with the arc-shaped slot 146 restricts rotation of the latching member to an approximately 90 degree range.

Figure 2:
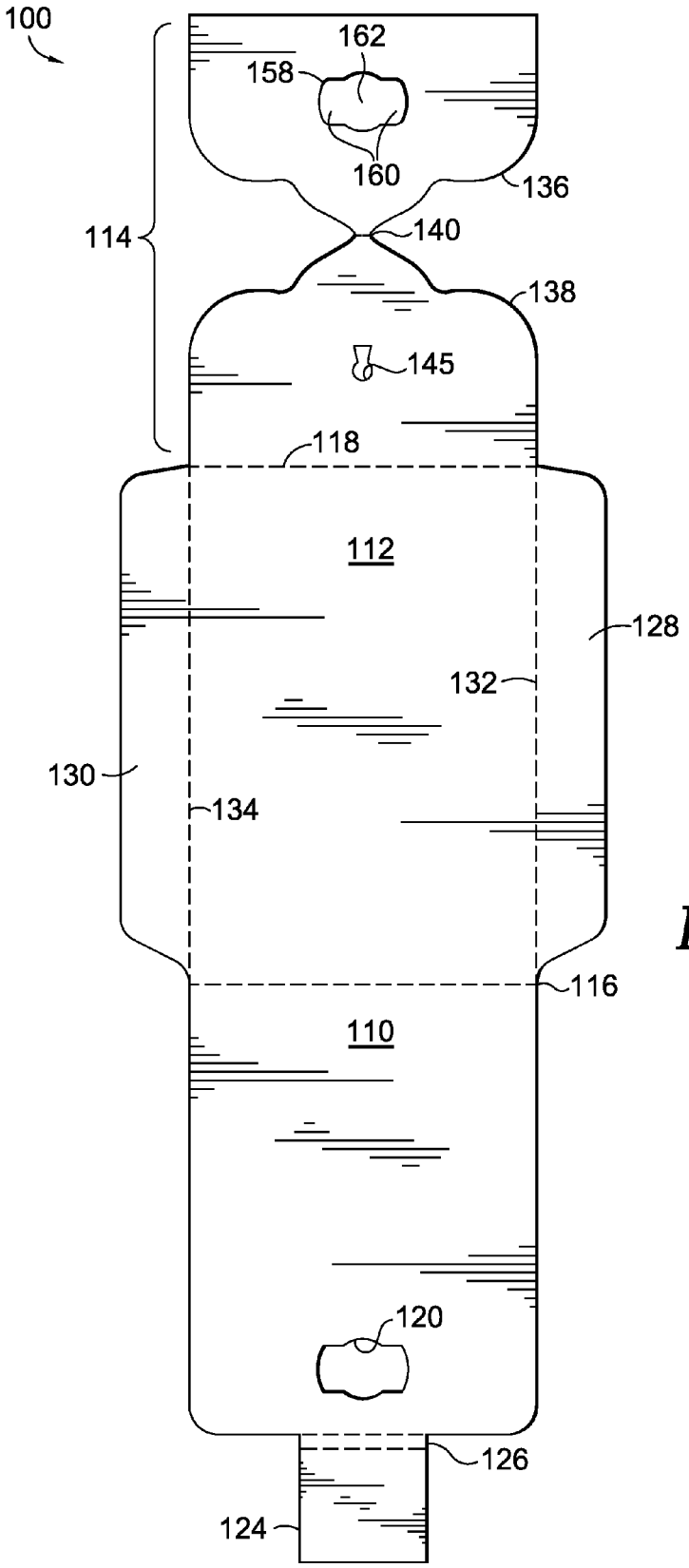
FIG. 2 is a top plan view of an exterior face of the article with the latching mechanism in a deconstructed arrangement in accordance with embodiments of the present invention.

Turning now to FIG. 2, FIG. 2 depicts a top plan view of an exterior face of the envelope 100 in a deconstructed arrangement. FIG. 2 includes many of the same elements as FIG. 1, and like numbers are used to indicate elements that are the same in FIGS. 1 and 2. The discussion of FIG. 2 will mainly focus on the distinctions between the interior face and the exterior face of the envelope 100.

As shown, the exterior face of the front panel 110 includes the receiving aperture 120 in the form of a cutout that extends through the thickness of the front panel 110. The exterior face of the proximal panel 138 also includes a centrally-situated aperture 145 which comprises a cutout through the thickness of the proximal panel 138. When the envelope 100 is in the as-constructed arrangement, the centrally-situated aperture 145 aligns with the centrally-situated aperture 144 of the non-rotatable portion 142 and the centrally-situated aperture 152 of the rotatable body 154. This view of the centrally-situated aperture 145 is presented to the user when the envelope 100 is in the as-constructed arrangement.

The exterior face of the distal panel 136 includes the rotatable latching member 158. The latching member 158 may be constructed of card stock or other similar materials. In the illustrated embodiment, the latching member 158 is constructed of 20 pt. card stock, although other thicknesses are contemplated as being within the scope of the invention. In the illustrated embodiment, the latching member 158 includes a central body 162 and two ears 160 that integrally extend from the central body 162. The latching member 158 is connected to the rotatable body 154 of the rotation restriction mechanism via one or more attaching segments as shown in FIG. 5.

Figure 5:
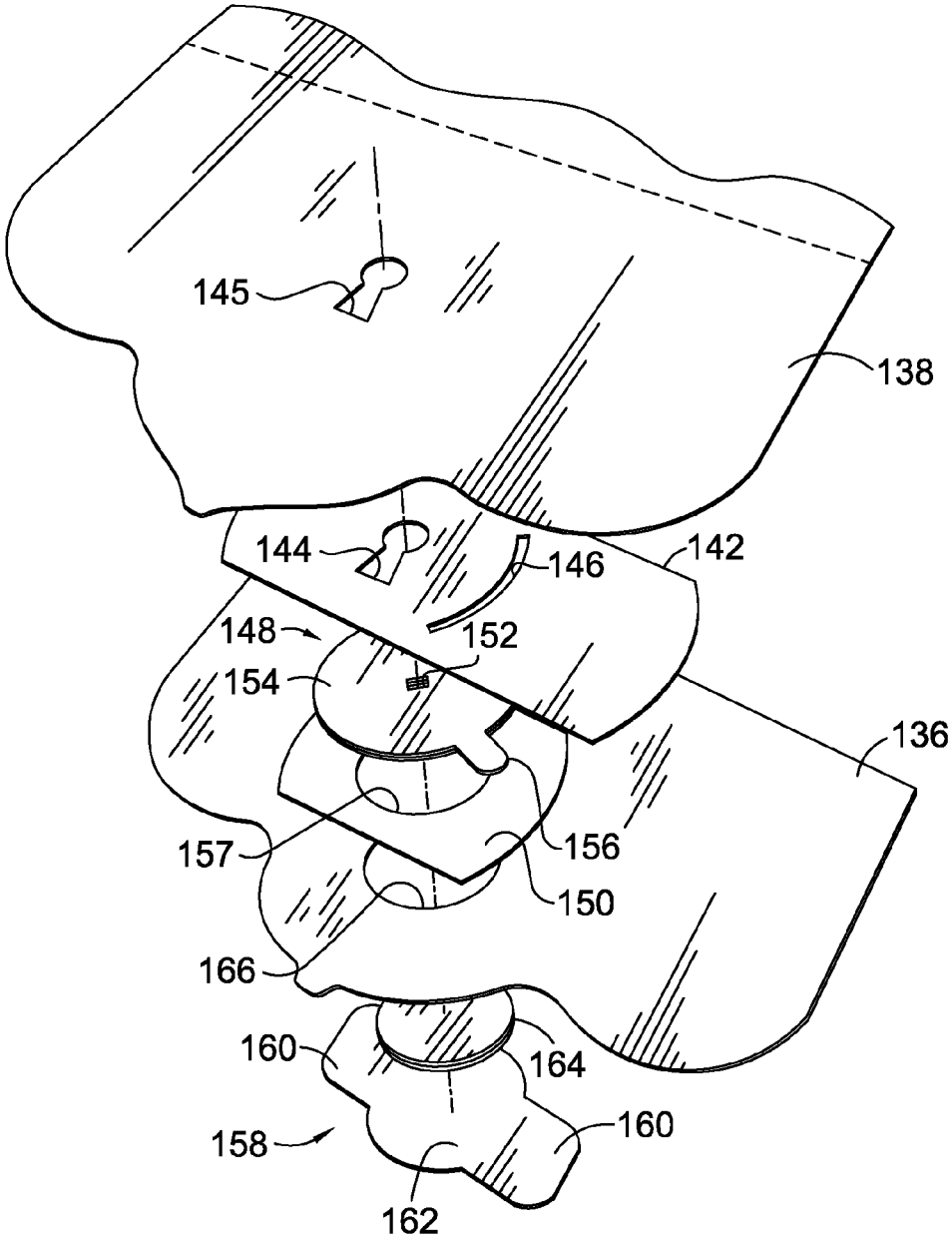
FIG. 5 is an enlarged partial exploded perspective view of the latching member and the rotation restriction mechanism of the closure flap in accordance with embodiments of the present invention.

FIG. 5 depicts a partial exploded perspective view of the different components and the different panels of the closure flap 114; the view illustrates the interplay amongst the different components and panels when the envelope 100 is in the as-constructed arrangement. FIG. 5 includes the same elements as FIGS. 1 and 2, and like numbers are used to indicate elements that are the same as those in FIGS. 1 and 2. Starting from the top of FIG. 5, the exterior face of the proximal panel 138 with the centrally-situated aperture 145 is shown. As seen, the centrally-situated aperture 145 comprises a cutout through the thickness of the proximal panel 138.

Next in FIG. 5, is the non-rotatable portion 142 of the rotation restriction mechanism that is attached to the interior face of the proximal panel 138. As shown, the non-rotatable portion 142 includes the arc-shaped slot 146 that receives the finger 156 of the rotatable portion 148 of the rotation restriction mechanism. The non-rotatable portion 142 also includes the centrally-situated aperture 144 that aligns with the centrally-situated aperture 145 when the envelope 100 is in the as-constructed arrangement.

Next is the rotatable portion 148 of the rotation restriction mechanism. The rotatable portion 148 includes the rotatable body 154, the finger 156, and the centrally-situated aperture 152. The finger 156 is inserted into the arc-shaped slot 146 when the envelope 100 is in the as-constructed arrangement. Insertion of the finger 156 into the arc-shaped slot 146 limits the rotation of the rotatable body 154 to an approximately 90 degree range of rotation. As seen in FIG. 5, the centrally-situated aperture 152 aligns with the centrally-situated apertures 144 and 145 when the envelope 100 is in the as-constructed arrangement. As shown in FIG. 5, the rotatable body 154 comprises a two or more-ply arrangement of layers.

Next is the reinforcing layer 150 that is affixed to the interior face of the distal panel 136. The reinforcing layer 150 has a cutout 157 located in approximately the middle of the reinforcing layer 150. The cutout 157 may be in the form of a circle or other shape.

Next is the interior face of the distal panel 136. As shown in FIG. 5, there is a cutout 166 that extends through the thickness of the distal panel 136 and is located generally in the middle of the distal panel 136. The cutout 166 may have a shape corresponding to the cutout 157 of the reinforcing layer 150. When the envelope 100 is in the as-constructed arrangement, the cutout 166 of the distal panel 136 aligns with the cutout 157 of the reinforcing layer 150.

Continuing, next there is a plurality of attaching segments 164. When the envelope 100 is in the as-constructed arrangement, the attaching segments 164 are situated in the cutouts 157 and 166 and are attached to the rotatable portion 148 as well as to the latching member 158 using affixing technologies known in the art. The number of attaching segments 164 may vary depending on the thickness of the materials used to construct the distal panel 136 and the reinforcing layer 150. In the illustrated embodiment, there are two attaching segments 164 that are affixed to each other, although a fewer or a greater number of attaching segments 164 are contemplated. The attaching segments 164 may be constructed from paper, card stock, or other suitable materials. In the illustrated embodiment, the attaching segments 164 are constructed from card stock; each attaching segment 164 has a thickness ranging from approximately 0.2 to 0.5 mm.

Next is the latching member 158 that has the body 162 and the ears 160. The latching member 158 is attached to the attaching segments 164 using affixing technologies known in the art. The combination of the rotatable portion 148, the attaching segments 164, and the latching member 158 act as a single unit. Thus, rotation of, for example, the rotatable portion 148 via an object inserted into the aperture 145 causes a concomitant rotation of the attaching segments 164 and the latching member 158.

Figure 3:
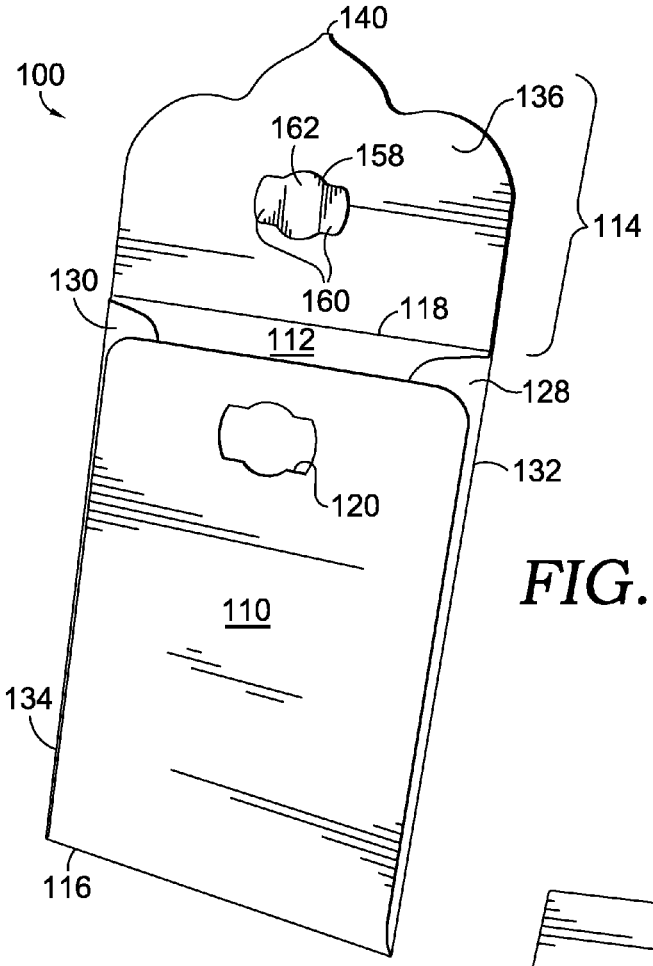
FIG. 3 is a top plan view of a first face of the closure flap of the article with the latching mechanism in an as-constructed arrangement and in an open position in accordance with embodiments of the present invention.
Figure 4:
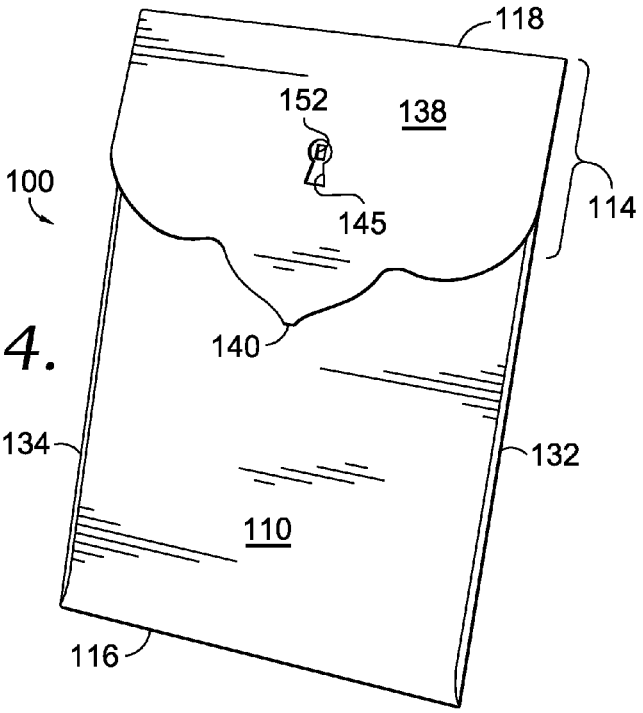
FIG. 4 is a top plan view of a second face of the closure flap of the article with the latching mechanism in an as-constructed arrangement and in a closed position in accordance with embodiments of the present invention.

Turning now to FIGS. 3 and 4, these figures illustrate one face of the envelope 100 in the as-constructed arrangement. FIG. 3 depicts the closure flap 114 in an open position, and FIG. 4 depicts the closure flap 114 when it is releasably secured to the front panel 110. FIG. 3 illustrates how the front panel 110 has been pivoted along the fold line 116 and attached to the back panel 112 via the wings 128 and 130 such that the exterior face of the front panel 110 is visible to the user. The wings 128 and 130 have been pivoted inwardly along the fold lines 132 and 134 prior to attachment to the front panel 110. As seen, when the envelope 100 is in the as-constructed arrangement, the front panel 110 and the back panel 112 are in parallel with each other and define a receptacle for receiving, for example, a card or other gift items.

FIG. 3 further depicts the receiving aperture 120. The receiving aperture 120 comprises a cutout through the thickness of the front panel 110. As described earlier, the tab 124 in the as-constructed arrangement is pivoted inwardly and attached to the spacer 122 thereby creating a cavity defined by a first surface of the tab 124 and the spacer 122. The cavity is open to the exterior via the receiving aperture 120.

FIG. 3 also depicts the closure flap 114. In this view, the exterior face of the distal panel 136 of the closure flap 114 is shown; it is connected to the proximal panel 138 (not shown in this figure) via the fold line 140. The latching member 158 with its body 162 and ears 160 is also shown in FIG. 3. As illustrated, the latching member 158 has a shape corresponding to the receiving aperture 120. The latching member 158 is currently in a first position that aligns with the receiving aperture 120. In the first position, the latching member 158 can be inserted into the receiving aperture 120. Once received by the receiving aperture 120, the latching member 158 is enclosed in the cavity created by the tab 124 and the spacer 122.

FIG. 4 depicts the envelope 100 when the closure flap 114 is pivoted inwardly along the fold line 118 and releasably secured to the front panel 110 via the latching member 158. The closure flap 114 is releasably secured to the front panel 110 when, after the latching member 158 has been received into the receiving aperture 120, the latching member 158 is rotated to a second position which causes the ears 160 to rotate behind the front panel 110 thereby securing the closure flap 114 to the front panel 110. When the envelope 100 is in the closed position, the exterior face of the proximal panel 138 is visible to the user. The exterior face of the proximal panel 138 includes the centrally-situated aperture 145. Also visible in FIG. 4, is the centrally-situated aperture 152 of the rotatable portion 148 of the rotation restriction mechanism. Insertion and rotation of an object, such as a key, into the centrally-situated apertures 145 and 152 enables a user to effectuate rotation of the latching member 158 from the first position to the second position and vice versa.

Figure 6:
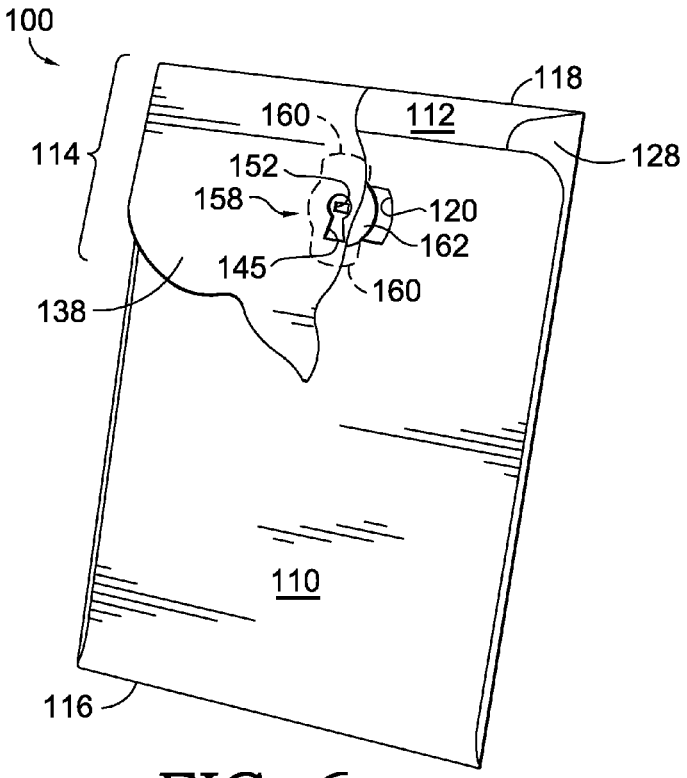
FIG. 6 is a view of the article showing portions cut-away and illustrating the closure flap releasably secured to the front panel of the article in accordance with embodiments of the present invention.

FIG. 6 depicts a view with portions of the closure flap 114 cut-away. FIG. 6 includes many of the same elements as FIGS. 1-5 and like numbers are used to illustrate like elements. FIG. 6 is provided to illustrate how the latching member 158 is rotated to the second position to releasably secure the closure flap 114 to the front panel 110 of the envelope 100. As shown, the body 162 of the latching member 158 has been rotated such that the ears 160 of the latching member 158 are behind the front panel 110. This arrangement effectively secures the closure flap 114 to the front panel 110.

Figure 7:
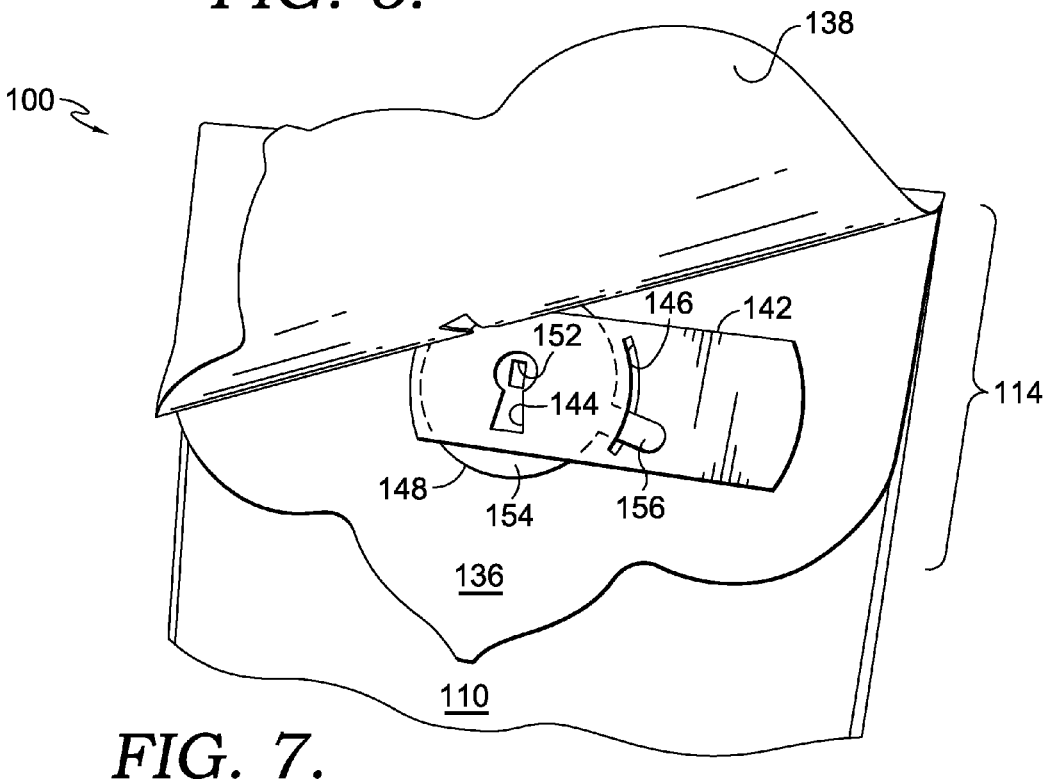
FIG. 7 is a view of the article showing portions of the closure flap peeled back to show the latching mechanism and the rotation restriction mechanism in accordance with embodiments of the present invention.

FIG. 7 is a view showing the proximal panel 138 "peeled back" and is used to illustrate how the rotation restriction mechanism operates. Specifically, FIG. 7 depicts the non-rotatable portion 142 of the rotation restriction mechanism with its arc-shaped slot 146 and its centrally-situated aperture 144. Although not shown for the sake of clarity, the non-rotatable portion 142 is attached to the proximal panel 138 when the envelope 100 is in the as-constructed arrangement. The rotatable portion 148 of the rotation restriction mechanism comprises the rotatable body 154, the finger 156, and the centrally-situated aperture 152.

FIG. 7 illustrates how when the envelope 100 is in the as-constructed arrangement, the finger 156 resides in the arc-shaped slot 146. Rotation of the rotatable portion 148 via an object inserted into the centrally-situated apertures 144 and 152 causes the finger 156 to rotate through a range of motion limited by the two ends of the arc-shaped slot 146. Thus, the length of the arc-shaped slot 146 acts to restrict the rotation of the rotatable body 154 (and, by extension, the latching member 158) to a specified range of motion. In the illustrated embodiment, this range of motion is approximately 90 degrees.

To use the envelope 100, in one embodiment, a user may insert a gift item, such as a card, into the receptacle defined by the front panel 110 and the back panel 112 of the envelope 100. Once inserted, the user can close the closure flap 114 by pivoting the closure flap 114 along the fold line 118 so that the latching member 158 of the envelope 100 is received by the receiving aperture 120 upon closure of the closure flap 114. As explained above, the latching member 158 is receiving into the cavity created by the tab 124 and the spacer 122. The position of the latching member 158 such that it can be received by the receiving aperture 120 is deemed the first position.

Once the latching member 158 is received by the receiving aperture 120, the user can insert an object, such as a plastic key, into the centrally-situated aperture 145 located on the exterior face of the proximal panel 138. Insertion of the object into the aperture 145 also causes the object to be inserted into the centrally-situated aperture 144 of the non-rotatable portion 142 and the centrally-situated aperture 152 of the rotatable portion 148 of the rotation restriction mechanism. After inserting the object into the apertures 145, 144, and 152, the user can rotate the object in, for example, a clockwise direction to initiate the rotation of the latching member 158 from the first position to a second position. In the second position, the ears 160 of the latching member 158 are situated behind the front panel 110 thereby releasably securing the closure flap 114 to the front panel 110. Rotation of the object by the user is limited to a specified range of motion because the finger 156 of the rotatable portion 148 abuts the ends of the arc-shaped slot 146 of the non-rotatable portion 142 at the end of the rotation range.

When a user wishes to remove the gift item from the envelope 100, the user can insert the object back into the apertures 145, 144, and 152, and rotate the object in, for example, a counter-clockwise direction to initiate the rotation of the latching member 158 from the second position back to the first position where the latching member 158 aligns with the receiving aperture 120. The user can then pivot the closure flap 114 away from the envelope body along the fold line 118 to reveal the contained gift item.

Many variations can be made to the illustrated embodiment of the present invention without departing from the scope of the present invention. Such modifications are within the scope of the present invention. For example, while the article with the latching mechanism has been depicted as an envelope, other exemplary articles include gift bags, gift boxes, and other three-dimensional products. The construction of these three-dimensional products may include additional fold lines than those depicted in FIGS. 1-7. Further, although a plastic key has been mentioned as an object that can be used to releasably secure the closure flap of the envelope, other objects are contemplated such as a stylus, a fingertip, and the like.

The present invention has been described in relation to particular embodiments, which are intended in all respects to be illustrative rather than restrictive. Alternative embodiments will become apparent to those of ordinary skill in the art to which the present invention pertains without departing from its scope.

Various embodiments of the invention have been described to be illustrative rather than restrictive. Alternative embodiments will become apparent from time to time without departing from the scope of embodiments of the inventions. It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative of applications of the principles of this invention, and not in a limiting sense.

What is claimed is:

1. An envelope having a latching mechanism, the envelope comprising:

a front panel having a receiving aperture;

a back panel connected with the front panel along a first common edge, wherein the back panel is in parallel with the front panel when the envelope is in an as-constructed arrangement, and wherein the back panel and the front panel define a receptacle for receiving an item;

a closure flap connected with the back panel along a second common edge; and a latching member rotatably coupled to the closure flap and positioned on the closure flap to align with the receiving aperture when the envelope is in an as-constructed arrangement, wherein the latching member:

has a centrally-situated aperture configured to receive an object, in a first position aligns with the receiving aperture and can be inserted therein and in a second position is rotated to maintain the latching member within the receiving aperture, and is rotatable from the first position to the second position upon insertion of the object in the centrally-situated aperture.

2. The envelope of claim 1, wherein the receiving aperture comprises a cutout of sufficient size to receive the latching member.

3. The envelope of claim 1, wherein the latching member is non-metal.

4. The envelope of claim 3, wherein the latching member is constructed of card stock.

5. The envelope of claim 1, wherein the latching member has a shape corresponding to the shape of the receiving aperture.

6. The envelope of claim 1, wherein upon insertion of the latching member into the receiving aperture and upon rotation of the object in a clockwise direction, the latching member is rotated from the first position to the second position and the closure flap is releasably secured to the front panel.

7. The envelope of claim 6, wherein upon rotation of the object in a counter-clockwise direction, the latching member is rotated from the second position to the first position and the closure flap is released from the front panel.

8. An article having a latching mechanism, the article comprising:

a front panel having a receiving aperture;

a back panel connected with the front panel along a first common edge, wherein at least a portion of the back panel is in parallel with at least a portion of the front panel when the article is in an as-constructed arrangement, and wherein the back panel and the front panel define a receptacle for receiving an item;

a closure flap connected with the back panel along a second common edge;

a latching member rotatably coupled to the closure flap and positioned on the closure flap to align with the receiving aperture when the article is in an as-constructed arrangement, wherein the latching member: wherein the latching member:

has a first centrally-situated aperture configured to receive an object, in a first position aligns with the receiving aperture and can be inserted therein, and in a second position is rotated to maintain the latching member within the receiving aperture, and is rotatable from the first position to the second position upon insertion of the object in the first centrally-situated aperture; and a rotation restriction mechanism coupled to the closure flap and positioned on the closure flap to align with the latching member, wherein the rotation restriction mechanism restricts rotation of the latching member to a predefined range of rotation.

9. The article of claim 8, wherein the front panel further includes a tab portion that is connected to the front panel along a common third common edge, and wherein the tab overlies the receiving aperture on an interior face of the front panel when the article is in the as-constructed arrangement.

10. The article of claim 9, wherein the tab is spaced apart from the receiving aperture by a spacer to create a cavity when the article is in the as-constructed arrangement, and wherein the cavity is configured to further receive the latching member.

11. The article of claim 10, wherein the cavity is of a size sufficient to allow rotation of the latching member from the first position to the second position.

12. The article of claim 8, wherein the rotation restriction mechanism comprises:

a rotatable portion that is attached to the latching member via one or more attachment segments, the rotatable portion comprising at least a central body and a finger extending from the central body, wherein the central body includes the first centrally-situated aperture; and a non-rotatable portion having: 1) a second aperture that aligns with the first centrally-situated aperture when the article is in the as-constructed arrangement, and 2) a slot configured to receive the finger of the rotatable portion when the article is in the as-constructed arrangement, wherein the slot has a length that restricts the rotation of the latching member to a 90 degree range.

13. The article of claim 8, wherein the article is constructed entirely of paper or card stock.

14. The article of claim 8, wherein the article comprises an envelope, a gift box, or a gift bag.

15. An envelope having a latching mechanism, the envelope comprising:

a front panel having an interior face and an exterior face, the front panel comprising:

(1) a receiving aperture having a shape, (2) a spacer located on the interior face of the front panel and surrounding the receiving aperture, and (3) a tab extending from the front panel and connected with the front panel along a first fold line, wherein the tab is pivotable with respect to the front panel along the first fold line, and wherein the tab overlies the spacer on the interior face of the front panel to create a cavity when the envelope is in an as-constructed arrangement;

a back panel connected with the front panel along a second fold line, wherein the back panel is in parallel with the front panel when the envelope is in the as-constructed arrangement, and wherein the back panel and the front panel define a receptacle for receiving a card when the envelope is in the as-constructed arrangement; and a closure flap having an interior face and an exterior face, the closure flap comprising a distal panel and a proximal panel, wherein the proximal panel is connected with the back panel along a third fold line and the distal panel is connected with the proximal panel along a fourth fold line, wherein the distal panel comprises:

(1) a latching member rotatably coupled to an exterior face of the distal panel and positioned on the distal panel to align with the receiving aperture when the envelope is in the as-constructed arrangement, the latching member comprising a central body and a pair of ears extending from the central body, the latching member having a shape corresponding to the shape of the receiving aperture of the front panel such that the latching member can be inserted into the receiving aperture to releasably secure the closure flap to the front panel of the envelope, and (2) a rotatable portion of a rotation restriction mechanism positioned on an interior face of the distal panel, the rotatable portion of the rotation restriction mechanism comprising a body having a first centrally-situated aperture configured to receive an object and a finger integrally attached to and extending from the body, wherein the rotatable portion of the rotation restriction mechanism is connected to the latching member via one or more attaching segments that extend through the distal panel of the closure flap;

and wherein the proximal panel comprises:

(1) a non-rotatable portion of the rotation restriction mechanism positioned on an interior face of the proximal panel, wherein the non-rotatable portion of the rotation restriction mechanism comprises: 1) a centrally-situated aperture that aligns with the centrally-situated aperture of the rotatable portion of the rotation restriction mechanism, and 2) a slot configured to receive the finger of the rotatable portion of the rotation restriction mechanism when the envelope is in the as-constructed arrangement, wherein the slot has a length sufficient to restrict the rotation movement of the latching member through a 90 degree range.

16. The envelope of claim 15, wherein the object comprises a key, and wherein insertion and rotation of the key in the first and second centrally-situated apertures causes the latching member to rotate from a first position to a second position.

17. The envelope of claim 16, wherein rotation of the latching member from the first position to the second position releasably secures the closure flap to the front panel when the envelope is in the as-constructed arrangement, and wherein rotation of the latching member from the second position to the first position releases the closure flap from the front panel.

18. The envelope of claim 17, wherein the latching member is constructed from card stock.

* * * * *